United States Patent [19]

Mann

[11] 4,079,625

[45] Mar. 21, 1978

[54] PROBING DEVICE FOR INVESTIGATION OF THE EARTH

[75] Inventor: Adriaan B. Mann, Delft, Netherlands

[73] Assignee: Goudsche Machinefabriek B.V., Gouda, Netherlands

[21] Appl. No.: 699,657

[22] Filed: Jun. 24, 1976

[30] Foreign Application Priority Data

Jun. 25, 1975 Netherlands ..... 7507567

[51] Int. Cl.[2] ..... E21B 47/06

[52] U.S. Cl. ..... 73/151

[58] Field of Search ..... 73/84, 88 E, 151

[56] References Cited

FOREIGN PATENT DOCUMENTS 167,657 2/1965 U.S.S.R. ..... 73/84

*Primary Examiner*—Jerry W. Myracle

*Attorney, Agent, or Firm*—Finnegan, Henderson, Farabow & Garrett

[57] ABSTRACT

A probing device for investigating earth pressures including a drill tube having therein at least one linear displacement meter, including a feeler, inserted in an elastic measuring cylinder sensitive to earth pressure exerted on the drill tube, the feeler interacting with a stop element abutting the elastic measuring cylinder. The probing device includes a thrust cone for sensing soil pressure and a shiftable portion of the casing of the drill tube for sensing holding compression. An additional linear displacement meter and a continuously horizontal stop surface may be utilized for measuring inclination of the device.

8 Claims, 4 Drawing Figures

PROBING DEVICE FOR INVESTIGATION OF THE EARTH

Figure 1:
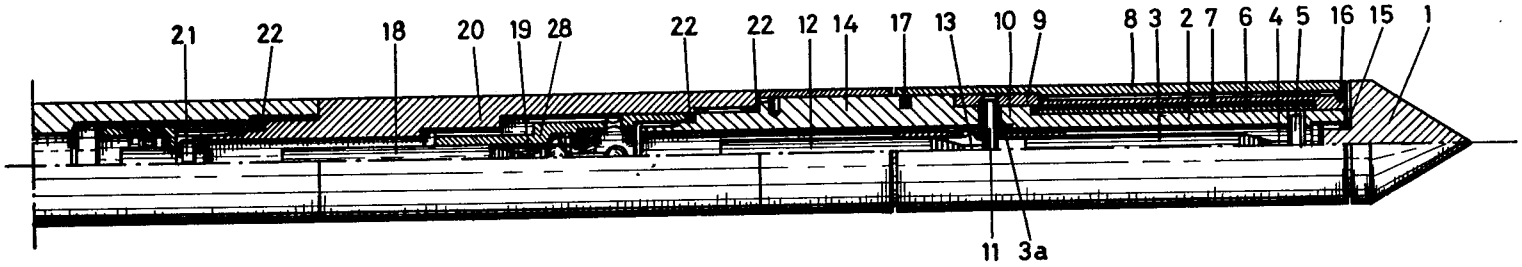

This invention relates to a probing device for investigation of the earth or soil, comprising a drill tube including at least one electric measuring element for measuring earth mechanical parameters, a conducting lead and a measuring unit. Such a probing device is known in practice.

In such a probing device a plurality of tensile or stretching strips near to a thrust cone fitted to the bottom side of the probing device, are used as a measuring element for measuring the earth pression or the portative power. Also in a further embodiment of such a probing device one or a plurality of stretching strips are fitted in longitudinal direction to a certain portion of the casing in order to measure the holding compression based upon friction and adhesion of the ground sliding alongside the drill tube and surrounding it.

Such embodiments have some disadvantages, namely the deviation of the zero point of the stretching strip upon overloading which necessitates a new calibration or replacement of the stretching strip; the temperature sensibility of the stretching strip through which the zero point deviates and which necessitates a new calibration or temperature correction with the aid of a parallel resistance; and the relatively small output signal of the stretching strip of 12 mV for example upon full load which makes this element sensitive to ambient influences, contact resistance and variation in the power supply.

Accordingly, it is an object of this invention to obviate these disadvantages and to provide a probing device, in which the measuring element upon overloading stays unimpaired and for which element no special calibration for temperature compensation is required and which device supplies a relatively large output signal.

In accordance with the invention a probing device therefore is provided which uses a linear displacement meter as measuring element, which displacement meter is fitted axially in the drill tube and which rests with its feeler against a stop element such that pressure exerted by the earth upon a portion of the drill tube is transmitted via an elastic measuring element and the stop element and impresses the feeler. This earth pressure can comprise soil pressure and/or water pressure.

A further embodiment of the probing device according to the invention is characterized in that the elastic measuring element is a measuring cylinder in which the linear displacement meter is inserted such that the measuring cylinder with the aid of a holder clamps one side of the displacement meter and holds the stop element on the other side of the displacement meter, the holder or the stop element being adjustable in axial direction in the measuring cylinder.

A further embodiment of the probing device according to the invention which is provided with a thrust cone for measuring the soil pressure, is characterized in that the length of the measuring cylinder is almost as large as the linear displacement meter for the soil pressure measurement.

A further embodiment of the probing device according to the invention which is provided with at least one electric measuring element co-operating with a certain portion of the casing of the drill tube for the measurement of the holding compression, which portion is shiftable in some degree in longitudinal direction, is characterized in that the length of the measuring cylinder is almost as large as the linear displacement meter for the friction pression measurement.

A further embodiment of the probing device according to the invention which is also provided with a thrust cone for the measurement of the soil pressure, is characterized in that the elastic measuring element consists of a cup spring or a spiral spring.

Abovementioned and further embodiments have the advantage that the linear displacement meter can be inserted in the drill tube in a simple manner, while in the probing devices known up to now the measuring element forms an unbreakable portion of the measuring cylinder, and should be considered with it as an entirety. Upon overloading the linear displacement meter in the probing device according to the invention stays unimpaired and, if needed, it is only required to replace a part of the casing.

Also abovementioned and further embodiments have the advantage that they are robust and that they are less sensitive to ambient influences. For example, they are insensitive to moisture as moisture when penetrating in the drill tube despite the joint rings, has no detrimental effect on the displacement meter.

In a further embodiment an additional linear displacement meter is inserted axially in the drill tube as an inclination or slope meter, the feeler of which rests upon a stop surface which stays horizontal. The usual probing device for the investigation of the earth are driven in the earth to relatively great depths, such that it is not always possible to maintain these devices truly vertical. In order to obtain useful measuring data the pressure measurements should be related to the correct depth. Consequently there is an additional need for an inclination meter which is able to continuously transmit with great sensitivity a deviation from the vertical of the probing device to the above-placed measuring unit. In an embodiment of the construction co-operating with the inclination meter, the stop surface which stays horizontal, is a flattened top portion of a ball, which is supported in a freely rotatable manner in each vertical plane and to the bottom side of which via a rigid swing rod a weight is fixed, which weight is freely movable in a space within the drill tube.

In a further embodiment separately or additionally a linear displacement meter is inserted axially in the drill tube as a water tension meter for the measurement of the water tension only. Via a moisture-transmitting element this water tension is applied to a measuring cylinder and the associated displacement meter.

Abovementioned embodiments can be applied in various combinations with each other in one construction.

The applied linear displacement meters are commercially available, linear electric sensing meters for measuring lengths or changes in dimensions. These sensing meters have a small cross-sections and have a relatively small longitudinal dimension such that they can be inserted in a simple manner in the drill tube. The associated feeler will, when impressed, effect a change in the inductance of the enclosing coil, by which a changing output voltage is emitted with great accuracy to the associated measuring unit. These displacement meters for example have a measuring distance of about 1 mm and they have a total stroke of about 3 mm.

Figure 2:
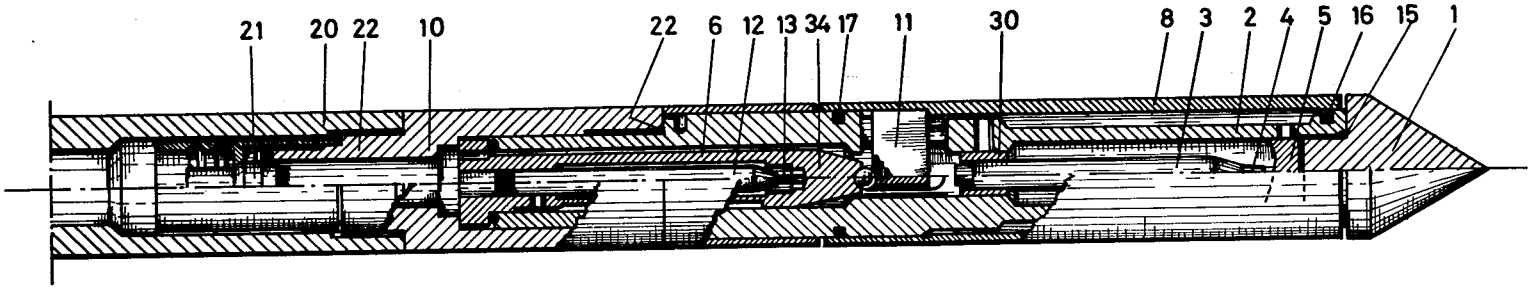
Figure 3:
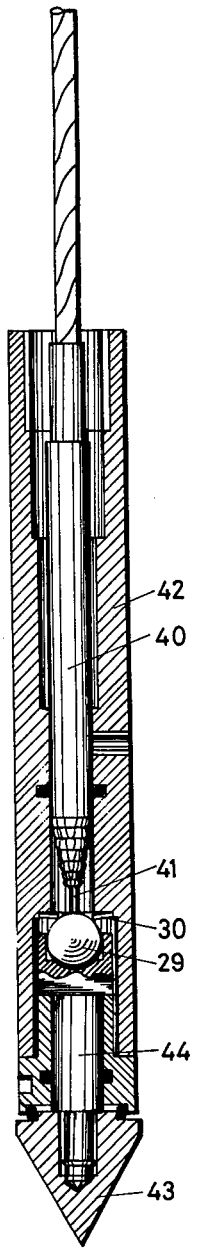
Figure 4:
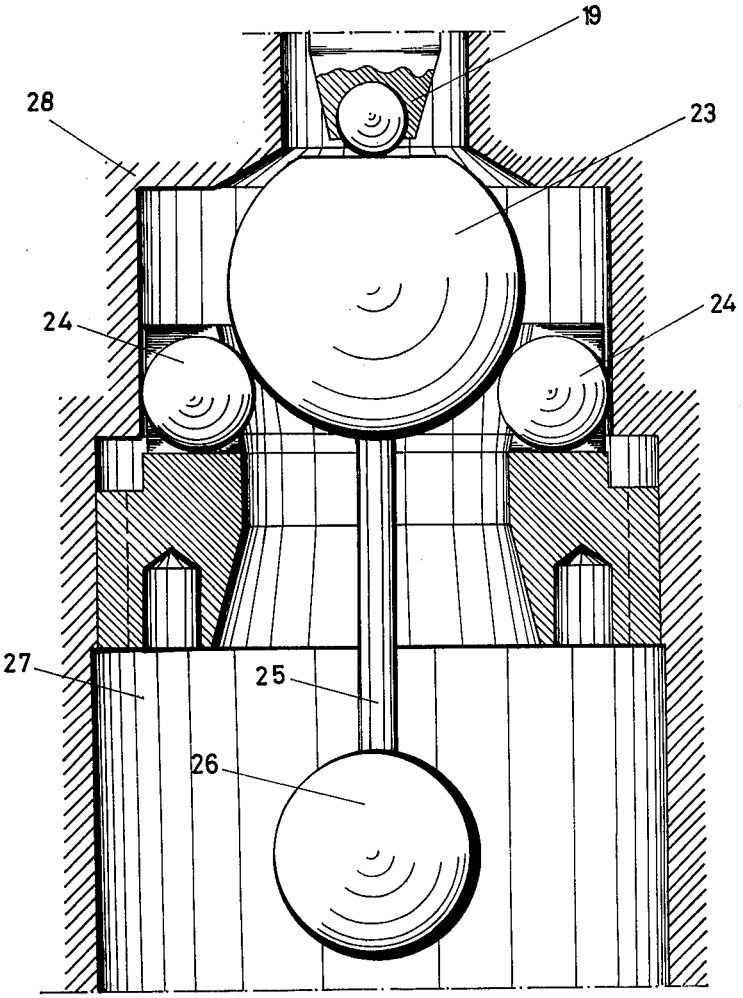

The invention will be explained on the basis of embodiment-examples with reference to the drawings, in which:

FIG. 1 gives a cross-section of a probing device according to the invention, provided with three displacement meters;

FIG. 2 gives a cross-section of a probing device according to the invention, provided with two displacement meters;

FIG. 3 gives a cross-section of a probing device according to the invention, provided with one displacement meter for the measurement of very small soil pressures; and FIG. 4 gives a cross-section of the construction of the inclination meter of the probing device indicated in FIG. 1.

In the probing device of FIG. 1 and FIG. 2 the number 1 indicates a thrust cone, 2 a measuring cylinder, 3 a first displacement meter and 3*a* an associated holder and 4 the associated feeler, 5 a stop element, 6 and 7 two measuring cylinders in FIG. 1 and 6 a measuring cylinder in FIG. 2, 8 a certain portion of the casing, 9 a shoulder piece of the inner cylinder 7 in FIG. 1, and 9 a loose stop portion in FIG. 2, 10 a shoulder piece, 11 and 11*a* second stop elements, 12 a second displacement meter and 13 the associated feeler, 15, 16, 17 and 22 anti-moisture joint rings, 18 a third displacement meter in FIG. 1 and 19 the associated feeler, 20 a fixed casing portion of the drill tube, 21 a terminal connector for connection of the electrical leads of the displacement meters to the conductor to the measuring unit, 28 a house for a swing construction.

The probing device functions as follows. When the drill tube is driven into the earth, the thrust cone 1 will experience a certain counter pressure which is transmitted as an impression to the stop element 5. The feeler 4 will be impressed somewhat as the housing of the displacement meter 3 is contained by means of the holder 3*a*. Accordingly a changing output voltage is supplied which can be read off on the measuring unit in a digital or analogue manner and which gives an indication of the cone pressure.

The transmission of the holding compression or friction compression exerted on the casing portion 8 is implemented as follows. The casing portion 8 has a small clearance in longitudinal direction. The friction resistance exerted on this casing portion causes an upward force against the shoulder or stop portion 9 which transmits the whole force to the measuring cylinders 6 and 7 of FIG. 1 and to the measuring cylinder 6 of FIG. 2 respectively. The measuring cylinder 6 finds its reaction at the shoulder portion 10.

As a result of this load on the measuring cylinders 6 and 7 of FIG. 1 and on the measuring cylinder 6 of FIG. 2 respectively, the feeler 13 of the second displacement meter 12 is impressed through the portion 34 of the cylinder 6 and a changing output voltage is supplied which is a measure for the total encountered holding compression.

The third displacement meter 18 with its feeler 19 of FIG. 1, which displacement meter is inserted in the fixed casing portion 20, functions as inclination meter in co-operation with the swing construction 28.

Each displacement meter is connected to the terminal connector 21 with electric leads (not shown).

In FIG. 3 a probing device is indicated provided with a single displacement meter, which probing device is used for measuring small pressures in a sensitive manner. A die 44 is screwed in the thrust cone 43, which die comprises a ball 29. The feeler 41 of the displacement meter 40 rests on this ball 29. Between the ball 29 and the house 42 a cup spring or spiral spring 30 is fitted as an elastic measuring element. The connection lead in this construction is directly connected to the measuring unit.

In FIG. 4 the swing or pendulum construction associated with the displacement meter is indicated. In this construction 28 indicates the house, 23 a ball having a flattened top portion, 24 are balls, 25 is a rigid swing rod and 26 is a weight. The inclination meter functions as follows. When the drill tube on a certain depth experiences a deviation with respect to the vertical for whatever reason, the pendulum 25–26 again will adapt a vertical position as a result of its weight in the free space, by which the rigid fastened ball 23 on the bearing 24 also regains its position such that its flattened top portion is horizontal again. As the displacement meter 18 with its feeler 19 is inserted axially in the drill tube and which displacement meter also adopts the position deviating with respect to the vertical, the feeler 19 will be lifted somewhat such that the displacement meter delivers a changing voltage which is a measure for the magnitude of the inclination.

It is possible to insert separately or additionally a linear displacement meter axially in the drill tube as a water tension meter for measuring the water tension only. This water tension is applied to a measuring cylinder and the associated displacement meter via a moisture transmitting element.

It will be apparent to those skilled in the art that various modifications and variations could be made in the probing device of the invention without departing from the scope or spirit of the invention. For example, the position of the displacement meter for measuring the friction pressure or the position of the inclination meter is not limited to the positions shown in the drawings, or the various displacement meters with their associated functions can be utilized singly or, in combination, as desired.

I claim:

1. In a probing device for investigating earth pressures, the probing device including a drill tube having therein at least one electric measuring element for converting earth mechanical parameters to electric units, the improvement wherein said measuring element includes a linear displacement meter having a feeler for sensing linear displacement and wherein said improvement includes an elastic measuring element sensitive to earth pressure exerted on a portion of the drill tube and stop element means abutted by said elastic measuring element, said stop element interacting with said feeler.

2. The improvement according to claim 1 wherein the elastic measuring element includes a measuring cylinder having the linear displacement meter inserted therein and wherein said improvement also includes a holder means for clamping one side of the displacement meter and retaining the stop element means on the other side of the displacement meter, the holder means or the stop element means being adjustable in the axial direction in the measuring cylinder.

3. The improvement according to claim 2 wherein the probing device includes a thrust cone for measuring soil pressure, said measuring cylinder being linearly sensitive to the displacement of the thrust cone and wherein said stop element means is fixed in said measuring cylinder.

4. The improvement according to claim 3 wherein said drill tube includes a casing, a portion of said casing being shiftable in some degree in the longitudinal direction, and wherein said improvement also includes at least one linear displacement meter cooperating with said shiftable portion for measuring the holding compression.

5. The improvement according to claim 2 wherein said drill tube includes a casing, a portion of said casing being shiftable in some degree in the longitudinal direction, and wherein said improvement also includes at least one linear displacement meter cooperating with said shiftable portion for measuring the holding compression.

6. The improvement according to claim 1 wherein the probing device includes a thrust cone for measuring soil pressure, said elastic measuring element being linearly sensitive to the displacement of said thrust cone and wherein said elastic measuring element is a spring.

7. The improvement according to claim 1 including at least a first and a second linear displacement meter, said second linear displacement meter functioning as an inclination meter, and wherein said stop element means includes means for maintaining horizontal the surface of said stop element means interacting with said feeler of said second linear displacement meter.

8. The improvement according to claim 7 wherein said means for maintaining said surface horizontal includes a ball mounted in said drill tube for free rotation therein, said horizontal surface being a flattened surface of said ball, a swing rod having one end rigidly fastened to said ball opposite said flattened surface and a weight fastened to the other end of said swing rod, said swing rod and weight being freely movable within said drill tube.

* * * * *